United States Patent [19]

Yan

[11] Patent Number: 4,828,591

[45] Date of Patent: May 9, 1989

[54] METHOD AND APPARATUS FOR THE LIQUEFACTION OF NATURAL GAS

[75] Inventor: Tsoung Y. Yan, Philadelphia, Pa.

[73] Assignee: Mobil Oil Corporation, New York, N.Y.

[21] Appl. No.: 229,200

[22] Filed: Aug. 8, 1988

[51] Int. Cl.[4] ..... F25J 1/00

[52] U.S. Cl. ..... 62/9; 62/40; 62/41

[58] Field of Search ..... 62/9, 11, 23, 36, 44, 62/41, 42

[56] References Cited

U.S. PATENT DOCUMENTS

| | | | |
|---|---|---|---|
| 3,364,685 | 1/1968 | Perret | 62/9 |
| 3,407,052 | 10/1968 | Huntress et al. | 62/9 X |
| 3,593,535 | 12/1969 | Gaumer, Jr. et al. | 62/23 |
| 4,758,257 | 7/1988 | Gates et al. | 62/23 |

OTHER PUBLICATIONS

Predicted and Actual Temperature Profiles and Pressure Drops in Large Coil Wound, Mixed Refrigerant Heat Exchangers (1980), by J. M. Geist, et al. at LNG 6, Session 2, Apr. 7–10, 1980, Kyoto, Japan.

*Primary Examiner*—Steven E. Warner
*Attorney, Agent, or Firm*—Alexander J. McKillop; Charles J. Speciale

[57] ABSTRACT

A system and a process are provided for cooling a natural gas feed to an aluminum heat exchanger to protect it from mercury damage and increase productivity. A multi-stage vaporization system is employed wherein the last stage or lowest pressure heat exchanger is provided with a propane ejector. This allows the last stage heat exchanger to operate at a very low pressure without unduly reducing the pressure within other parts of the system. The last stage heat exchanger is accordingly able to sufficiently reduce the temperature of the feed to the aluminum heat exchanger to protect against mercury contamination. In addition, the decreased heat transfer load of the aluminum heat exchanger leads to an increase in the LNG production rate.

31 Claims, 1 Drawing Sheet

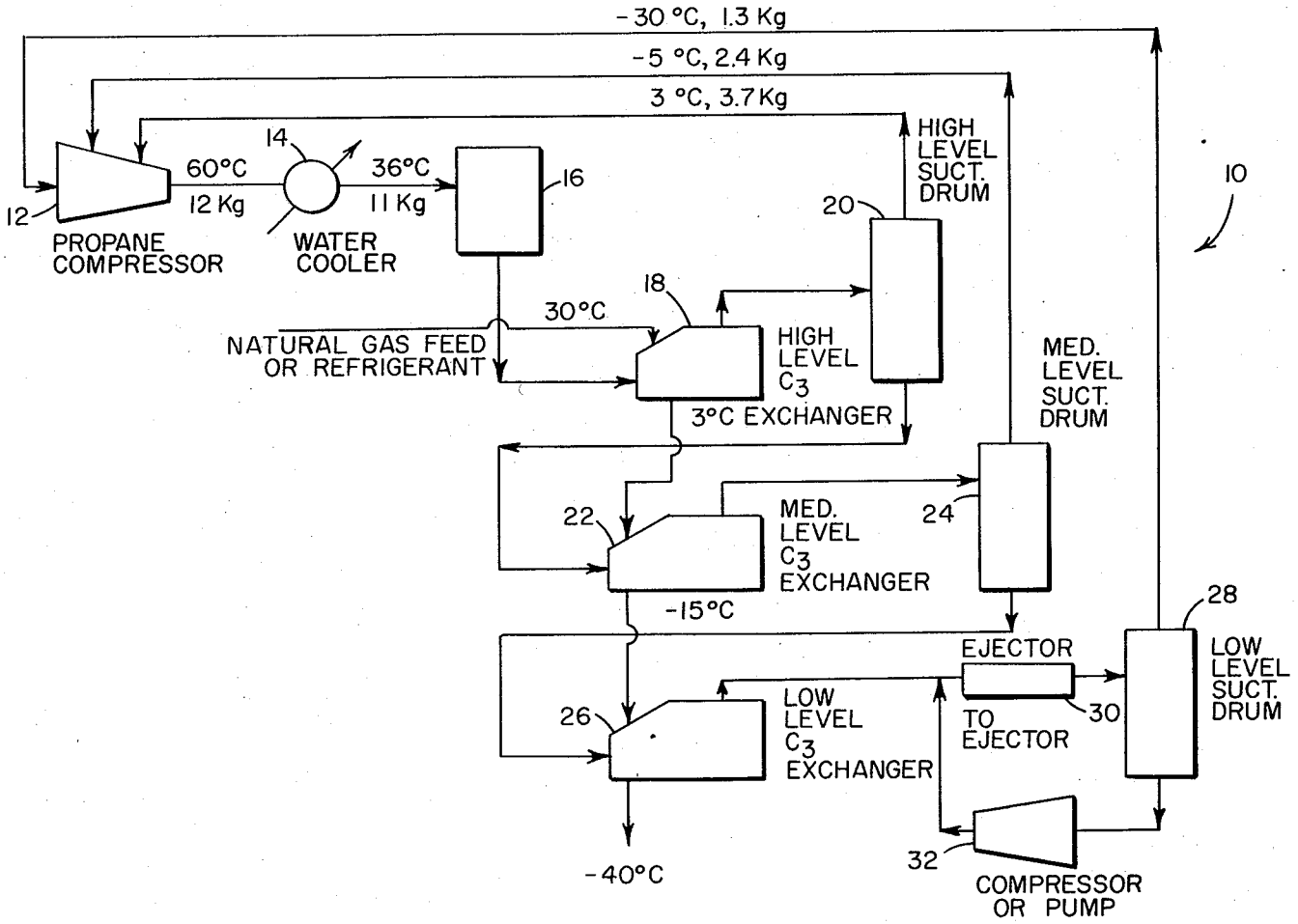
10
-30 °C, 1.3 Kg
-5 °C, 2.4 Kg
3 °C, 3.7 Kg
12
PROPANE COMPRESSOR
60°C
12 Kg
14
36°C
11 Kg
WATER COOLER
16
30°C
NATURAL GAS FEED OR REFRIGERANT
18
HIGH LEVEL C3 EXCHANGER
3°C
20
HIGH LEVEL SUCT. DRUM
22
MED. LEVEL C3 EXCHANGER
-15°C
24
MED. LEVEL SUCT. DRUM
26
LOW LEVEL C3 EXCHANGER
-40°C
28
LOW LEVEL SUCT. DRUM
30
EJECTOR
TO EJECTOR
32
COMPRESSOR OR PUMP

METHOD AND APPARATUS FOR THE LIQUEFACTION OF NATURAL GAS

This invention relates to a system and a process for the liquefaction of natural gas (or other elemental mercury vapor-containing hydrocarbon gas such as effluent from steam crackers for $C_2$= and $C_3$= production) employing a cryogenic heat exchanger fabricated from aluminum, and particularly to a method and apparatus for cooling the natural gas feed to such a heat exchanger.

The liquefaction of natural gas for storage and transportation and regasification for final distribution is a well established technology. Liquefied natural gas (LNG) represents an economically attractive energy option, especially for industrial nations short on domestic fuel reserves.

Several types of natural gas liquefaction processes are known. One conventional LNG process, the standard cascade system, uses three different refrigerants, i.e., methane, ethylene and propane, circulating in closed cycles. One example of such a system is described in U.S. Pat. No. 3,593,535. An improvement over the standard cascade system employs a single-pressured mixed refrigerant cascade (MRC) system. In one version of the MRC system described in Geist et al., "Predicted and Actual Temperature Profiles and Pressure Drops in Large Coil Wound, Mixed Refrigerant Heat Exchangers," *LNG6*, Session II, Paper 4, Apr. 7-10, 1980, Kyoto, Japan, a natural gas feed following treating and drying is precooled in an auxiliary heat exchanger supplied with propane refrigerant. Thereafter, the chilled gas is introduced into a cryogenic main heat exchanger (MHE) where liquefaction takes place. The MHE is horizontally divided into an upper cold bundle absorbed by propane and a lower warm bundle absorbed by mixed refrigerant.

The industry, in general, is predominantly reliant on propane as a refrigerant. Such reliance poses serious problems, especially from the standpoint of obtaining very low temperatures. It is quite difficult to provide very low temperatures by use of propane. Propane as a refrigerant is limited by its boiling point at a workable pressure of about 20 psi.

Regardless of the liquefaction system used, aluminum is often the material of choice for the construction of the cryogenic heat exchanger due to its high thermal conductivity, excellent low temperature properties, machinability and relatively low cost. However, aluminum is susceptible to corrosion by the mercury which is present in natural gas, e.g., from as low as about 0.005 to as high as about 200 micrograms per normal cubic meter (i.e., from about $5.5\times10^{-3}$ to about 220 parts per billion by volume). Concentrations of mercury greater than about 0.01 micrograms per normal cubic meter are generally regarded as undesirable especially where aluminum cryogenic liquefaction equipment is concerned due to mercury's capability for forming a corrosive amalgam with aluminum. This type of amalgamation weakens the aluminum heat exchanger by creating cracks which can ultimately result in explosions of the higher pressur vessels.

Although it is a conventional practice to demercurate natural gas (see, for example, the demercuration processes described in U.S. Pat. Nos. 3,193,987; 3,803,803; 4,101,631; 4,474,896; 4,491,609; 4,474,896; and, 4,500,327), a sufficient amount of mercury will often remain in the post-treated gas as to pose a significant safety and maintenance problem where aluminum cryogenic heat exchangers are concerned. It has been found that, in its solid state, however, i.e., below its point of solidification, mercury does not form an amalgam with aluminum. The industry's reliance on propane as a refrigerant has until now limited the ability to attain the temperature required to solidify the mercury in mercury-containing natural gas streams.

For example, in one current system, the propane is compressed and cooled to liquid propane. The liquid propane is used in a three-step, cascaded propane chiller by vaporization at 7° C. and 5 Kg/Cm$^2$, −9° C. and 2.5 Kg/Cm$^2$ and −30° C. and 1.3 Kg/Cm$^2$, respectively. The final stage of vaporization is at 1.3 Kg/Cm$^2$ so as to maintain the compressor suction pressure to assure operational safety. As a result, the temperature at the last chiller (heat exchanger) can only reach −30° C.

In accordance with the teachings contained within commonly assigned U.S. application Ser. No. 107,750 filed Oct. 13, 1987 for a "Process For The Liquefaction Of Natural Gas", which is incorporated by reference herein, the mercury-containing gas stream can be sequentially cooled after a first precooling step in which the stream is preferably reduced to about −22° C. when the stream is a natural gas stream. The second precooling stage, which can include a reduced sized vessel utilizing a propane/ethane mixture or propane at a low pressure condition of about 1.0 atmosphere or lower as a refrigerant, preferably reduces the temperature of the gas stream to at least below about −39° C. before introducing the stream into the cryogenic heat exchanger. In this way, the mercury contained in the stream is solidified so that its potential effect on the aluminum heat exchanger is significantly reduced or completely eliminated. Alternatively, a small portion of the liquefied gas stream exiting the main cryogenic heat exchanger can be circulated to the mercury-containing stream after it has been precooled. This liquefied gas stream product used to precool can be at a temperature of about −252° C. When a precooling stream at this temperature is used, as little as 5% by weight can be added to the mercury-containing stream at about −22° C. to reduce it to a temperature of about −40° C. before entering the main cryogenic heat exchanger.

It is an object of this invention to reduce the corrosion potential of elemental mercury for aluminum cryogenic gas processing equipment by exploiting the observation that at or below its freezing point, mercury exhibits no appreciable tendency to form an amalgam with aluminum, specifically, by introducing the mercury-containing feed gas into the main heat exchanger (MHE) at a temperature at which the mercury is present in the gas in the solid state.

It is a particular object of the invention to cool the refrigerant employed in the liquefaction of natural gas to a sufficient extent that recycling of a portion of the liquefied gas stream exiting the main cryogenic heat exchanger does not need to be mixed with the precooled, mercury-containing stream as described above.

SUMMARY OF THE INVENTION

In accordance with the present invention, in a method and an apparatus for liquefying an elemental mercury vapor-containing gas in a cryogenic heat exchange, an improvement is provided which obviates the necessity of recycling any portion of the liquid natural gas product to the inlet of the main heat exchanger for cooling the feed via direct mixing.

In one embodiment of the invention, a cascaded system is employed for reducing the temperature of a refrigerant such as propane. Ejector means are provided at the outlet of the last stage heat exchanger so that it can be operated at about 0.1 to 1.2 $Kg/Cm^2$, while the downstream end of the ejector means (and a low pressure suction drum) is maintained at about 1.2 to 2.0 $Kg/Cm^2$. The refrigerant within the system serves as the ejector fluid.

If the load on the main refrigerant compressor is not to be increased, a second compressor or pump may be added to the system. The "booster" compressor is charged from the bottom of the low pressure suction drum. The compressed refrigerant is fed to the ejector means as the moving fluid. Since the temperature and pressure of the low pressure suction drum remain unchanged from the unmodified system without the booster compressor and ejector means, the load upon the main compressor remains the same.

The invention accordingly provides an increased LNG production rate wherein propane may safely be utilized as a refrigerant.

BRIEF DESCRIPTION OF THE DRAWING

The FIGURE is a schematic illustration of a low temperature propane refrigeration system in accordance with the invention.

DETAILED DESCRIPTION OF THE INVENTION

Referring to the drawing, a cascaded, low temperature propane refrigeration system 10 is provided for use in the liquefaction of natural gas. The system includes a main propane compressor 12, a water cooler 14, a reservoir 16, a high pressure heat exchanger 18, a high pressure suction drum 20, a medium pressure heat exchanger 22, a medium pressure suction drum 24, a low pressure heat exchanger 26 and a low pressure suction drum 28. A propane ejector 30 and a second compressor 32 or pump are added to the system in order to reduce the temperature of the natural gas feed to the main heat exchanger (not shown) to at least below about −39° C. The heat exchangers and suction drums employed in the system are all conventional components used in the liquefaction of natural gas.

The main propane compressor 12 is a three-port, three-stage compressor, each port admitting propane at different pressures. The pressure is raised to 2.4 $Kg/Cm^2$ at the first stage, to 3.7 $Kg/Cm^2$ at the second stage, and to about 12 $Kg/Cm^2$ at the third stage. The temperature is inherently raised during compression, and the propane is accordingly passed through the water cooler 14 to reduce both temperature and pressure to about 36° C. and eleven $Kg/Cm^2$, respectively. The reservoir 16 receives the refrigerant once it passes through from the water cooler 14.

The high pressure heat exchanger 18 receives the propane refrigerant from the reservoir 16 as well as the natural gas to be fed to the main heat exchanger. As the propane is evacuated through the high pressure suction drum 20, the temperature of the natural gas is reduced from about thirty degrees Centigrade to about three degrees Centigrade, whereupon it is directed to the medium pressure heat exchanger 22. Refrigerant for the medium pressure heat exchanger is drawn from the bottom of the high pressure suction drum 20. The temperature of the natural gas is reduced to about minus fifteen degrees Centigrade, and passes through a line to the low pressure heat exchanger 26. The outlet of this heat exchanger includes the propane ejector 30 which allows the heat exchanger to be operated at pressures between 0.1–1.2 $Kg/Cm^2$, preferably 0.5–1.0 $Kg/Cm^2$. The pressures at the downstream end of the ejector and within the low pressure suction drum 28 are maintained at about 1.2–2.0 $Kg/Cm^2$, and preferably about 1.4–1.6 $Kg/Cm^2$. This allows the compressor to operate safely without the danger of oxygen entering therein, and the natural gas to be reduced to a temperature of about minus forty degrees Centigrade before entering the main heat exchanger.

In the absence of the second compressor 32, the moving fluid for the ejector may be obtained from the high and medium pressure suction drums. A conventional steam-jet ejector can be employed, but a multiple nozzle booster ejector is preferred because of the relatively large volume requirements of the system. Ejection efficiency can be increased by cooling the moving fluid.

Because propane is preferably used as the moving fluid, the load of the first (low pressure) stage of the main propane compressor 12 is significantly increased in the system as so far described. The pressures and temperature of the high and medium pressure suction drums must accordingly be readjusted to balance the loads at the three stages of the main compressor. The temperatures therein would accordingly be lowered to about zero and minus twenty degrees Centigrade, respectively.

The system as described above is based on the assumption that the main compressor output can be increased to handle the increased compression load due to the ejector fluid. When the main compressor capacity is limited, the second compressor 32 is used. This booster compressor is incorporated within the loop shown in the FIGURE, and is charged from the bottom of the low pressure suction drum 28. Pressurized propane liquid or gas is fed to the ejector 30 at about two to six $Kg/Cm^2$ as the moving fluid. Since the temperature and pressure of the low pressure suction drum are unchanged from the unmodified system which does not include ejector means, the load upon the main compressor remains the same. A pump may be substituted for the second compressor in cases where the moving fluid is in a liquid state.

It will be appreciated that by repressurizing the third (low pressure) stage of the system, the low pressure heat exchanger can be operated at a reduced pressure, thereby lowering the temperature of the feed to the main heat exchanger to about minus forty degrees Centigrade. This not only prevents damage due to mercury in the portion of the main heat exchanger which would ordinarily not be cool enough to maintain mercury in its solid state, but also decreases the load upon the main heat exchanger. The LNG production rate is accordingly increased without extraordinary capital investment.

Finally, the system may also be employed for reducing the temperature of a refrigerant to be used in the main heat exchanger or elsewhere. This is accomplished by feeding a refrigerant into both sides of the first stage heat exchanger. Refrigerants other than propane may be utilized in accordance with the invention, such as ethane, butane or mixtures of various hydrocarbon gases and nitrogen.

What is claimed is:

1. A method for cooling a hydrocarbon fluid such as natural gas comprising the steps of:

compressing a fluid refrigerant;

passing said refrigerant successively through a plurality of heat exchangers, the pressure in each successive heat exchanger being less than the pressure in the preceding heat exchanger;

passing a second fluid successively through each of said heat exchangers such that the temperature of said second fluid is successively reduced as it passes through each successive heat exchanger; and repressurizing said refrigerant near an output of the last of said successive heat exchangers, thereby lowering the operating pressure and working temperature within said last of said successive heat exchangers.

2. A method as defined in claim 1 wherein said operating pressure within said last of said successive heat exchangers is lowered to between about 0.1–1.2 $kg/cm^2$.

3. A method as defined in claim 1 wherein said operating pressure within said last of said successive heat exchangers is lowered to between about 0.5–1.0 $kg/cm^2$.

4. A method as defined in claim 1 including the step of cooling said repressurized refrigerant.

5. A method as defined in claim 4 wherein said refrigerant is selected from the group consisting of propane, ethane and butane.

6. A method as defined in claim 1 wherein said refrigerant includes propane.

7. A method as defined in claim 6 wherein said refrigerant is repressurized by introducing a moving fluid near said output of the last of said successive heat exchangers, said moving fluid being comprised of said refrigerant.

8. A method as defined in claim 7 wherein said moving fluid is introduced via ejector means.

9. A method as defined in claim 8 including the step of compressing said refrigerant, and conveying said refrigerant to said ejector means.

10. A method as defined in claim 6 wherein said second fluid is natural gas.

11. A method as defined in claim 10 wherein the temperature of said natural gas is reduced at least to about 40° C. within said last of said successive heat exchangers.

12. A method as defined in claim 11 including the step of feeding said natural gas to a main heat exchanger from said last of said successive heat exchangers.

13. A method as defined in claim 6 wherein said refrigerant is compressed in a multi-stage, multi-port compressor, at least part of said refrigerant exiting each heat exchanger being recirculated through said compressor.

14. A method as defined in claim 13 including the steps of passing at least a portion of said refrigerant exiting each heat exchanger through one of a plurality of suction drums connected between each heat exchanger and said compressor.

15. A method as defined in claim 14 wherein said step of repressurizing said refrigerant includes introducing refrigerant from one of said suction drums near said output of the last of said successive heat exchangers.

16. A method as defined in claim 14 including the step of removing refrigerant from one of said suction drums, compressing said refrigerant removed from said one of said suction drums, and introducing said compressed refrigerant near said output of said last of said successive heat exchangers.

17. A method as defined in claim 16 wherein said one of said suction drums is connected between said last of said successive heat exchangers and said compressor.

18. A method as defined in claim 16 wherein said second fluid is natural gas.

19. A system for reducing the temperature of a hydrocarbon gas such as natural gas, comprising:

a compressor;

a plurality of heat exchangers arranged in stages for sequential cooling of a fluid;

means for conveying a refrigerant from said compressor to a first stage heat exchanger;

means for conveying a refrigerant from said first stage heat exchanger to a last stage heat exchanger;

means for conveying a fluid to be cooled from said first stage heat exchanger to said last stage heat exchanger;

means for recirculating refrigerant from each of said heat exchangers back to said compressor;

said last stage heat exchanger including a refrigerant outlet; and means for introducing a moving fluid near said outlet of said last stage heat exchanger, thereby reducing the pressure and working temperature within said last stage heat exchanger to promote cooling of said fluid.

20. A system as defined in claim 19 wherein said means for introducing a moving fluid near said outlet is an ejector.

21. A system as defined in claim 20 including means for feeding refrigerant to said ejector.

22. A system as defined in claim 21 wherein said feeding means includes a second compressor.

23. A system as defined in claim 22 including a suction drum connected between said last stage heat exchanger and said compressor, said second compressor being connected between said suction drum and said ejector.

24. A system as defined in claim 23 including at least one suction drum connected between each of said heat exchangers and said compressor.

25. A system as defined in claim 24 wherein said compressor is a multi-stage, multi-port compressor.

26. A system as defined in claim 24 including means for introducing said fluid from said last stage heat exchanger to a main heat exchanger.

27. A system as defined in claim 24 wherein said system is charged with a refrigerant including propane.

28. A system as defined in claim 27 wherein said heat exchangers contain natural gas.

29. A system as defined in claim 24 including a suction drum connected between said last stage heat exchanger and said first stage heat exchanger.

30. A system as defined in claim 29 including an intermediate stage heat exchanger connected between said first stage heat exchanger and said last stage heat exchanger.

31. A system as defined in claim 30 wherein the operating pressures of said heat exchangers are reduced, successively, from said first stage heat exchanger to said last stage heat exchanger.

* * * * *